US008817950B2

(12) United States Patent
Hansen et al.

(10) Patent No.: US 8,817,950 B2
(45) Date of Patent: Aug. 26, 2014

(54) X-RAY TUBE TO POWER SUPPLY CONNECTOR

(75) Inventors: William H. Hansen, Manteca, CA (US); Brian L. Taylor, Provo, UT (US); Dave Reynolds, Orem, UT (US); Dongbing Wang, Lathrop, CA (US)

(73) Assignee: Moxtek, Inc., Orem, UT (US)

( * ) Notice: Subject to any disclaimer, the term of this patent is extended or adjusted under 35 U.S.C. 154(b) by 333 days.

(21) Appl. No.: 13/493,695

(22) Filed: Jun. 11, 2012

(65) Prior Publication Data

US 2013/0163725 A1 Jun. 27, 2013

Related U.S. Application Data

(60) Provisional application No. 61/579,158, filed on Dec. 22, 2011.

(51) Int. Cl.
*H05G 1/10* (2006.01)

(52) U.S. Cl.
USPC ..... 378/101; 378/102

(58) Field of Classification Search
CPC ..... H05G 1/00; H05G 1/02; H05G 1/04; H05G 1/06; H05G 1/08; H05G 1/10; H05G 1/54; A61B 6/4405; A61B 6/4411
USPC ..... 378/101, 102
See application file for complete search history.

(56) References Cited

U.S. PATENT DOCUMENTS

| | | | |
|---|---|---|---|
| 1,946,288 | A | 2/1934 | Kearsley |
| 2,291,948 | A | 8/1942 | Cassen |
| 2,316,214 | A | 4/1943 | Atlee et al. |
| 2,329,318 | A | 9/1943 | Atlee et al. |
| 2,683,223 | A | 7/1954 | Hosemann |
| 2,952,790 | A | 9/1960 | Steen |
| 3,218,559 | A | 11/1965 | Applebaum |
| 3,356,559 | A | 12/1967 | Mohn et al. |
| 3,434,062 | A | 3/1969 | Cox |
| 3,679,927 | A | 7/1972 | Kirkendall |
| 3,801,847 | A | 4/1974 | Dietz |

(Continued)

FOREIGN PATENT DOCUMENTS

| | | |
|---|---|---|
| DE | 10 30 936 | 5/1958 |
| DE | 44 30 623 | 3/1996 |

(Continued)

OTHER PUBLICATIONS

U.S. Appl. No. 12/899,750, filed Oct. 7, 2010; Steven Liddiard; notice of allowance dated Jun. 4, 2013.

(Continued)

*Primary Examiner* — Jurie Yun
(74) *Attorney, Agent, or Firm* — Thorpe North & Western LLP

(57) ABSTRACT

An x-ray source can include an x-ray tube and a power supply. The x-ray tube can be removably affixed to the power supply in a rigid manner with the x-ray tube movable and holdable along with the power supply when affixed thereto. A releasable coupling between the x-ray tube and the power supply can create an interface defining a potential arc path. A means, such as a non-linear plug and socket junction, a gasket, or an electrically conductive sleeve, can be used for resisting arcing along the potential arc path.

20 Claims, 11 Drawing Sheets

(56) References Cited

U.S. PATENT DOCUMENTS 3,828,190 A 8/1974 Dahlin et al.
3,851,266 A 11/1974 Conway
3,872,287 A 3/1975 Koeman
3,882,339 A 5/1975 Rate et al.
3,894,219 A 7/1975 Weigel
4,007,375 A 2/1977 Albert
4,075,526 A 2/1978 Grubis
4,160,311 A 7/1979 Ronde et al.
4,184,097 A 1/1980 Auge
4,393,127 A 7/1983 Greschner et al.
4,400,822 A 8/1983 Kuhnke et al.
4,421,986 A 12/1983 Friauf et al.
4,463,338 A 7/1984 Utner et al.
4,504,895 A 3/1985 Steigerwald
4,521,902 A 6/1985 Peugeot
4,679,219 A 7/1987 Ozaki
4,688,241 A 8/1987 Peugeot
4,734,924 A 3/1988 Yahata et al.
4,761,804 A 8/1988 Yahata
4,777,642 A 10/1988 Ono
4,797,907 A 1/1989 Anderton
4,819,260 A 4/1989 Haberrecker
4,870,671 A 9/1989 Hershyn
4,891,831 A 1/1990 Tanaka et al.
4,969,173 A 11/1990 Valkonet
4,979,198 A 12/1990 Malcolm et al.
4,995,069 A 2/1991 Tanaka
5,010,562 A 4/1991 Hernandez et al.
5,063,324 A 11/1991 Grunwald
5,066,300 A 11/1991 Isaacson et al.
5,077,771 A 12/1991 Skillicorn et al.
5,077,777 A 12/1991 Daly
5,090,046 A 2/1992 Friel
5,105,456 A 4/1992 Rand et al.
5,117,829 A 6/1992 Miller et al.
5,153,900 A 10/1992 Nomikos et al.
5,161,179 A 11/1992 Suzuki et al.
5,178,140 A 1/1993 Ibrahim
5,187,737 A 2/1993 Watanabe
5,200,984 A 4/1993 Laeuffer
5,226,067 A 7/1993 Allred et al.
RE34,421 E 10/1993 Parker et al.
5,267,294 A 11/1993 Kuroda et al.
5,343,112 A 8/1994 Wegmann et al.
5,347,571 A 9/1994 Furbee et al.
5,391,958 A 2/1995 Kelly
5,400,385 A 3/1995 Blake et al.
5,422,926 A 6/1995 Smith et al.
5,428,658 A 6/1995 Oettinger et al.
5,469,429 A 11/1995 Yamazaki et al.
5,469,490 A 11/1995 Golden et al.
5,478,266 A 12/1995 Kelly
RE35,383 E 11/1996 Miller et al.
5,621,780 A 4/1997 Smith et al.
5,627,871 A 5/1997 Wang
5,631,943 A 5/1997 Miles
5,680,433 A 10/1997 Jensen
5,682,412 A 10/1997 Skillicorn et al.
5,696,808 A 12/1997 Lenz
5,729,583 A 3/1998 Tang et al.
5,812,632 A 9/1998 Schardt et al.
5,907,595 A 5/1999 Sommerer
5,978,446 A 11/1999 Resnick
6,005,918 A 12/1999 Harris et al.
6,044,130 A 3/2000 Inazura et al.
6,069,278 A 5/2000 Chuang
6,073,484 A 6/2000 Miller et al.
6,075,839 A 6/2000 Treseder
6,097,790 A 8/2000 Hasegawa et al.
6,129,901 A 10/2000 Moskovits et al.
6,133,401 A 10/2000 Jensen
6,134,300 A 10/2000 Trebes et al.
6,184,333 B1 2/2001 Gray
6,205,200 B1 3/2001 Boyer et al.
6,277,318 B1 8/2001 Bower et al.
6,282,263 B1 8/2001 Arndt et al.
6,288,209 B1 9/2001 Jensen
6,307,008 B1 10/2001 Lee et al.
6,320,019 B1 11/2001 Lee et al.
6,351,520 B1 2/2002 Inazaru
6,385,294 B2 5/2002 Suzuki et al.
6,388,359 B1 5/2002 Duelli et al.
6,438,207 B1 8/2002 Chidester et al.
6,477,235 B2 11/2002 Chornenky et al.
6,487,272 B1 11/2002 Kutsuzawa
6,487,273 B1 11/2002 Takenaka et al.
6,494,618 B1 12/2002 Moulton
6,546,077 B2 4/2003 Chornenky et al.
6,556,654 B1 * 4/2003 Hansen et al. ..... 378/101
6,567,500 B2 5/2003 Rother
6,658,085 B2 12/2003 Sklebitz
6,661,876 B2 12/2003 Turner et al.
6,740,874 B2 5/2004 Döring
6,778,633 B1 8/2004 Loxley et al.
6,799,075 B1 9/2004 Chornenky et al.
6,803,570 B1 10/2004 Bryson, III et al.
6,816,573 B2 11/2004 Hirano et al.
6,819,741 B2 11/2004 Chidester
6,852,365 B2 2/2005 Smart et al.
6,866,801 B1 3/2005 Mau et al.
6,876,724 B2 4/2005 Zhou et al.
6,956,706 B2 10/2005 Brandon
6,976,953 B1 12/2005 Pelc
6,987,835 B2 1/2006 Lovoi
7,035,379 B2 4/2006 Turner et al.
7,046,767 B2 5/2006 Okada et al.
7,049,735 B2 5/2006 Ohkubo et al.
7,050,539 B2 5/2006 Loef et al.
7,075,699 B2 7/2006 Oldham et al.
7,085,354 B2 8/2006 Kanagami
7,108,841 B2 9/2006 Smalley et al.
7,110,498 B2 9/2006 Yamada
7,130,380 B2 10/2006 Lovoi et al.
7,130,381 B2 10/2006 Lovoi et al.
7,203,283 B1 4/2007 Puusaari
7,206,381 B2 4/2007 Shimono et al.
7,215,741 B2 5/2007 Ukita
7,224,769 B2 5/2007 Turner
7,233,647 B2 6/2007 Turner et al.
7,286,642 B2 10/2007 Ishikawa et al.
7,305,066 B2 12/2007 Ukita
7,317,784 B2 1/2008 Durst et al.
7,358,593 B2 4/2008 Smith et al.
7,382,862 B2 6/2008 Bard et al.
7,428,298 B2 9/2008 Bard et al.
7,448,801 B2 11/2008 Oettinger et al.
7,486,774 B2 2/2009 Cain
7,526,068 B2 4/2009 Dinsmore
7,529,345 B2 5/2009 Bard et al.
7,634,052 B2 12/2009 Grodzins et al.
7,649,980 B2 1/2010 Aoki et al.
7,650,050 B2 1/2010 Haffner et al.
7,657,002 B2 2/2010 Burke et al.
7,675,444 B1 3/2010 Smith et al.
7,680,652 B2 3/2010 Giesbrecht et al.
7,693,265 B2 4/2010 Hauttmann et al.
7,709,820 B2 5/2010 Decker et al.
7,737,424 B2 6/2010 Xu et al.
7,756,251 B2 7/2010 Davis et al.
2003/0096104 A1 5/2003 Tobita et al.
2003/0152700 A1 8/2003 Asmussen et al.
2003/0165418 A1 9/2003 Ajayan et al.
2004/0076260 A1 4/2004 Charles, Jr. et al.
2005/0018817 A1 1/2005 Oettinger et al.
2005/0141669 A1 6/2005 Shimono et al.
2005/0207537 A1 9/2005 Ukita
2006/0073682 A1 4/2006 Furukawa et al.
2006/0098778 A1 5/2006 Oettinger et al.
2006/0210020 A1 9/2006 Takahashi et al.
2006/0233307 A1 10/2006 Dinsmore
2006/0269048 A1 11/2006 Cain
2006/0280289 A1 12/2006 Hanington et al.
2007/0025516 A1 2/2007 Bard et al.
2007/0111617 A1 5/2007 Meilahti

(56) References Cited

U.S. PATENT DOCUMENTS

| | | | |
|---|---|---|---|
| 2007/0183576 | A1 | 8/2007 | Burke et al. |
| 2007/0217574 | A1 | 9/2007 | Beyerlein |
| 2008/0296479 | A1 | 12/2008 | Anderson et al. |
| 2008/0296518 | A1 | 12/2008 | Xu et al. |
| 2008/0317982 | A1 | 12/2008 | Hecht et al. |
| 2009/0085426 | A1 | 4/2009 | Davis et al. |
| 2009/0086923 | A1 | 4/2009 | Davis et al. |
| 2009/0213914 | A1 | 8/2009 | Dong et al. |
| 2009/0243028 | A1 | 10/2009 | Dong et al. |
| 2010/0098216 | A1 | 4/2010 | Dobson |
| 2010/0126660 | A1 | 5/2010 | O'Hara |
| 2010/0189225 | A1 | 7/2010 | Ernest et al. |
| 2010/0243895 | A1 | 9/2010 | Xu et al. |
| 2010/0285271 | A1 | 11/2010 | Davis et al. |

FOREIGN PATENT DOCUMENTS

| | | |
|---|---|---|
| DE | 19818057 | 11/1999 |
| EP | 0 297 808 | 1/1989 |
| EP | 0330456 | 8/1989 |
| GB | 1252290 | 11/1971 |
| JP | 57 082954 | 5/1982 |
| JP | 3170673 | 7/1991 |
| JP | 5066300 | 3/1993 |
| JP | 06 119893 | 4/1994 |
| JP | 2003211396 | 7/2003 |
| JP | 2006297549 | 11/2006 |

OTHER PUBLICATIONS

U.S. Appl. No. 12/890,325, filed Sep. 24, 2010; Dongbing Wang; notice of allowance dated Jul. 16, 2013.

Chen, Xiaohua et al., "Carbon-nanotube metal-matrix composites prepared by electroless plating," Composites Science and Technology, 2000, pp. 301-306, vol. 60.

Flahaut, E. et al, "Carbon Nanotube-metal-oxide nanocomposites; microstructure, electrical conductivity and mechanical properties," Acta mater., 2000, pp. 3803-3812.Vo. 48.

Gevin et al., "IDeF-X V1.0: performances of a new CMOS multi channel analogue readout ASIC for Cd(Zn)Te detectors", IDDD, Oct. 2005, 433-437, vol. 1.

Grybos et al., "DEDIX—development of fully integrated multichannel ASCI for high count rate digital x-ray imaging systems", IEEE, 693-696, vol. 2, 2006.

Grybos et al., "Measurements of matching and high count rate performance of mulitchannel ASIC for digital x-ray imaging systems", IEEE, Aug. 2007, 1207-1215, vol. 54, Issue 4.

Grybos et al., "Pole-Zero cancellation circuit with pulse pile-up tracking system for low noise charge-sensitive amplifiers", Feb. 2008, 583-590, vol. 55, Issue 1.

http://www.orau.org/ptp/collectio/xraytubescollidge/MachlettCW250T.htm, 1999, 2 pages.

Hutchison, "Vertically aligned carbon nanotubes as a framework for microfabrication of high aspect ration mems," 2008, pp. 1-50.

Jiang, Linquin et al., "Carbon nanotubes-metal nitride composites; a new class of nanocomposites with enhanced electrical properties," J. Mater. Chem., 2005, pp. 260-266, vol. 15.

Li, Jun et al., "Bottom-up approach for carbon nanotube interconnects," Applied Physics Letters, Apr. 14, 2003, pp. 2491-2493, vol. 82 No. 15.

Ma. R.Z., et al., "Processing and properties of carbon nanotubes-nano-SIC ceramic", Journal of Materials Science 1998, pp. 5243-5246, vol. 33.

Micro X-ray Tube Operation Manual, X-ray and Specialty Instruments Inc., 1996, 5 pages.

Peigney, et al., "Carbon nanotubes in novel ceramic matrix nanocomposites," Ceramics International, 2000, pp. 677-683, vol. 26.

Rankov et al., "A novel correlated double sampling poly-Si circuit for readout systems in large area x-ray sensors", IEEE, May 2005, 728-731, vol. 1.

Satishkumar B.C., et al. "Synthesis of metal oxide nanorods using carbon nanotubes as templates," Journal of Materials Chemistry, 2000, pp. 2115-2119, vol. 10.

Sheather, "The support of thin windows for x-ray proportional counters," Journal Phys,E., Apr. 1973, pp. 319-322, vol. 6, No. 4.

Tamura et al., "Development of ASICs for CdTe pixel and line sensors", Oct. 2005, 2023-2029, vol. 52, Issue 5.

Wagner et al., "Effects of scatter in dual-energy imaging: an alternative analysis", Sep. 1989, 236-244, vol. 8, Issue 3.

Yan, Xing-Bin, et al., Fabrications of Three-Dimensional ZnO-Carbon Nanotube (CNT) Hybrids Using Self-Assembled CNT Micropatterns as Framework, 2007. pp. 17254-17259, vol. III.

Vajtai et al.; Building Carbon Nanotubes and Their Smart Architectures; Smart Mater. Struct.; 2002; vol. 11; pp. 691-698.

Chakrapani et al.; Capillarity-Driven Assembly of Two-Dimensional Cellular Carbon Nanotube Foams; PNAS; Mar. 23, 2004; pp. 4009-4012; vol. 101; No. 12.

U.S. Appl. No. 12/899,750, filed Oct. 7, 2010; Steven Liddiard.

U.S. Appl. No. 13/018,667, filed Feb. 1, 2011; Robert C. Davis.

U.S. Appl. No. 13/307,579, filed Nov. 30, 2011; Dongbing Wang.

U.S. Appl. No. 12/890,325, filed Sep. 24, 2010; Dongbing Wang; office action dated Sep. 7, 2012.

* cited by examiner

X-RAY TUBE TO POWER SUPPLY CONNECTOR

CLAIM OF PRIORITY

Priority is claimed to U.S. Provisional Patent Application Ser. No. 61/579,158, filed on Dec. 22, 2011, which is hereby incorporated herein by reference in its entirety.

FIELD OF THE INVENTION

This invention relates generally to x-ray tubes and x-ray tube power supplies.

BACKGROUND

A common x-ray tube and power supply configuration is for both to be integrally joined and have continuous, electrically insulative, potting material surrounding the two devices. The entire unit can be surrounded by an enclosure, typically at ground voltage. Electrically insulative material can insulate high voltage components of the x-ray tube and power supply from the enclosure.

A reason for integrally joining the two devices in this manner is that a voltage differential of tens of kilovolts can exist between the enclosure and wires from the power supply to the x-ray tube, and it can be difficult to electrically isolate this large voltage potential. Difficulty of isolating the two voltages is especially difficult in small, portable, x-ray sources, in which a distance between the high voltage wires and the enclosure can be about 1 cm, but the voltage differential can be around 50 kilovolts.

A problem of the above configuration, with x-ray tube and power supply integrally joined, is that if one device fails, both devices must normally be scrapped. It would be beneficial to have a removable connection between the x-ray tube and the power supply so that the two may be connected and disconnected at will, allowing replacement of one of the devices upon failure, while saving the other device. Such a connection can be difficult because an electrical arc can travel more easily along a junction of the connection between the two devices. Any air trapped in such connection can be especially harmful, because an electrical current can arc through the air causing the air to ionize resulting in breakdown of surrounding potting. Thus, the device can easily fail due to arcing along a connection between x-ray tube and power supply.

One design for a removable connection 210 between an x-ray tube and a power supply is shown in FIGS. 21-22. A plug 73 and a socket 74 can be used to increase a path length that electrical current would need to travel in order to cause a short circuit. Either the x-ray tube or the power supply can be the device 71 attached to the plug ("plug device") and the other of the x-ray tube or the power supply can be the device 72 attached to the socket ("socket device"). One possible difficulty of this design can be an undesirably long plug length L for very high voltage applications, especially if there are size constraints. Another possible difficulty of this design can be trapped air.

SUMMARY

It has been recognized that it would be advantageous to have a removable connection between x-ray tube and power supply that allows these two devices to be connected and disconnected and also minimizes potential electrical arcing along a junction of these two devices. It has also been recognized that it would be advantageous to have a removable connection that can minimize trapped air in the connection and/or minimize size. The present invention is directed to power supply to x-ray tube connections that satisfies these needs.

In one embodiment, the apparatus comprises a housing containing a power supply. The power supply can include electrical connectors. The electrical connectors can be configured to provide electrical power to an x-ray tube. The x-ray tube can be removably affixed to the housing in a rigid manner with the x-ray tube movable and holdable along with the housing when affixed thereto. A releasable coupling between the x-ray tube and the housing can create an interface defining a potential arc path. A means can be used for resisting arcing along the potential arc path. The means can be (1) a conductive sleeve embedded in flexible, elastic electrically insulative material partially surrounding a socket into which the x-ray tube is inserted; (2) a means for progressively compressing an annular gap oriented perpendicular to the electrical connectors in a radial outward direction; (3) a plug and a socket wherein tapered and/or annular surfaces of the plug and socket include a non-linear profile; or (4) combinations of the above.

In another embodiment, the apparatus comprises a power supply and an x-ray tube electrically, physically and releasably coupled together at a coupling formed therebetween. The coupling comprises a plug extending from one of the power supply or the x-ray tube and a socket extending in towards the other of the power supply or the x-ray tube. A plug annular surface can surround the plug at a base thereof and a socket annular surface can surround the socket at a leading edge thereof. The plug can have a tapered surface and a continuously reduced diameter from the base towards an end of the plug. The socket can have a tapered surface and a continuously reduced diameter from the leading edge towards a bottom of the socket. Mating electrical connectors associated with the plug and the socket can connect when the plug is disposed in the socket. The electrical connectors can be configured to allow electrical current to flow from the power supply to the tube when connected. The tapered surfaces, the annular surfaces, or both, can have a non-linear cross-sectional profile. The tapered surfaces and the annular surfaces of the plug and the socket can mate, with the plug insertable and receivable in the socket. The plug and the socket can comprise elastic, electrically insulative material. The tapered surfaces can abut one another when coupled.

In another embodiment, the apparatus comprises a coupling on a power supply or an x-ray tube. The coupling comprises a plug extending from, or a socket extending in towards, the power supply or the x-ray tube. The plug or the socket can have a tapered surface and a continuously reduced diameter. Electrical connectors can be associated with the plug or the socket. The electrical connectors can be configured to allow electrical current to flow from the power supply to the tube when connected. The tapered surface can have a non-linear profile. The plug or the socket can comprise elastic, electrically insulative material.

In another embodiment, the apparatus comprises a coupling on a power supply or an x-ray tube. The coupling comprises a plug extending from, or a socket extending in towards, the power supply or the x-ray tube. The plug or the socket can have a tapered surface and a continuously reduced diameter. An annular surface can surround the plug at a base or the socket at a leading edge thereof. Electrical connectors can be associated with the plug or the socket. The electrical connectors can be configured to allow electrical current to flow from the power supply to the tube when connected. The tapered surface, the annular surface, or both, can have a non-linear cross-sectional profile. The plug or the socket can comprise elastic, electrically insulative material.

DEFINITIONS

As used herein, the term "annular" includes non-circular ring shapes. Thus, for example a shape of the plug annular surface (that can surround the plug at a base thereof) is not limited to a circular inner and outer perimeter. A common shape of the plug annular surface will be a circular inner perimeter, to allow the plug to twist in the socket, and a square outer perimeter, to match the shape of an outer metal housing or shield.

DETAILED DESCRIPTION

Figure 1:
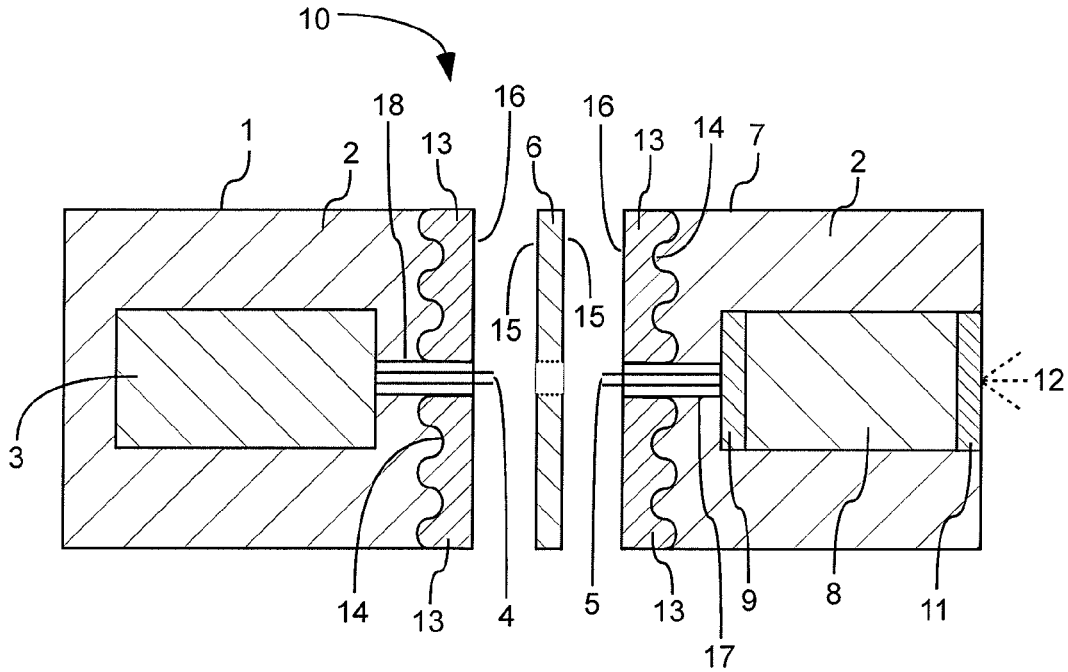
FIG. 1 is a schematic cross-sectional side view of an x-ray power supply, an x-ray tube, and a means for removably connecting the power supply and tube, in accordance with an embodiment of the present invention.
Figure 2:
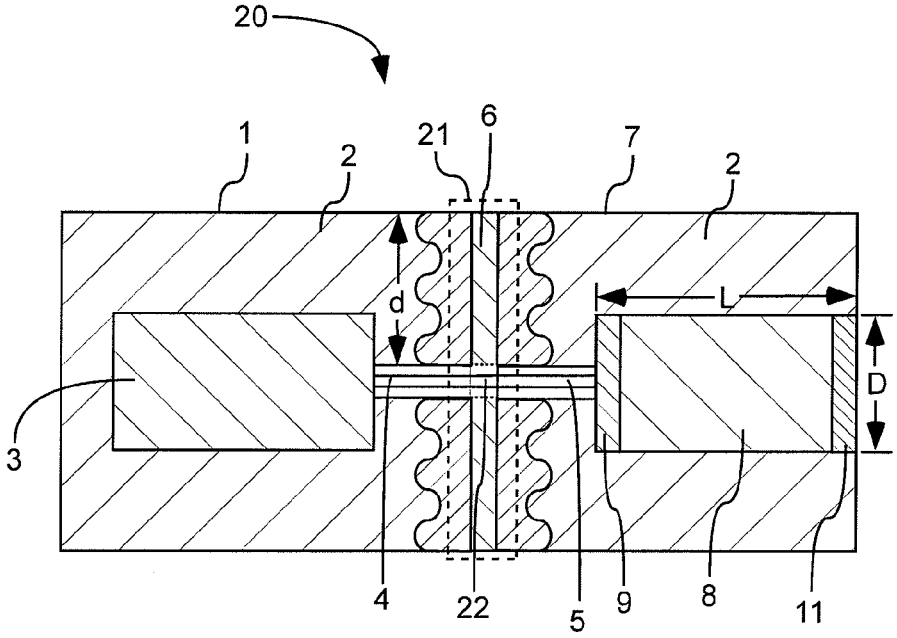
FIG. 2 is a schematic cross-sectional side view of an x-ray power supply removably joined to an x-ray tube, in accordance with an embodiment of the present invention.

Shown in FIGS. 1 and 2 are x-ray sources 10 and 20. Power supply 3, x-ray tube 8, and gasket 6 are shown as separate components in x-ray source 10 of FIG. 1, but are shown joined together in x-ray source 20 of FIG. 2, thus illustrating how the power supply 3 and x-ray tube 8 can be joined and separated, repeatedly without damage to the power supply 3 or the x-ray tube 8.

A housing 1 can contain the power supply 3. The power supply 3 can be embedded in electrically insulative potting material 2. The power supply 3 can include a pair of electrical connections 4 which are configured to provide electrical power to the x-ray tube 8. The electrical connections 4 can be wires that are enclosed in a case or tube 18. The case 18 can be electrically conductive and can be electrically connected to one of the electrical connections 4.

A shield 7 can contain the x-ray tube 8. The x-ray tube 8 can include a cathode 9, configured to emit electrons towards an anode 11. A target at the anode 11 can emit x-rays 12 in response to impinging electrons from the cathode 9. The x-ray tube can be removably, electrically coupled to two electrical connectors 5, configured to provide electrical power to the cathode 9. The electrical connectors 5 can be wires that are enclosed in a case or tube 17. The case 17 can be electrically conductive and can be electrically connected to one of the electrical connectors 5.

Figure 18:
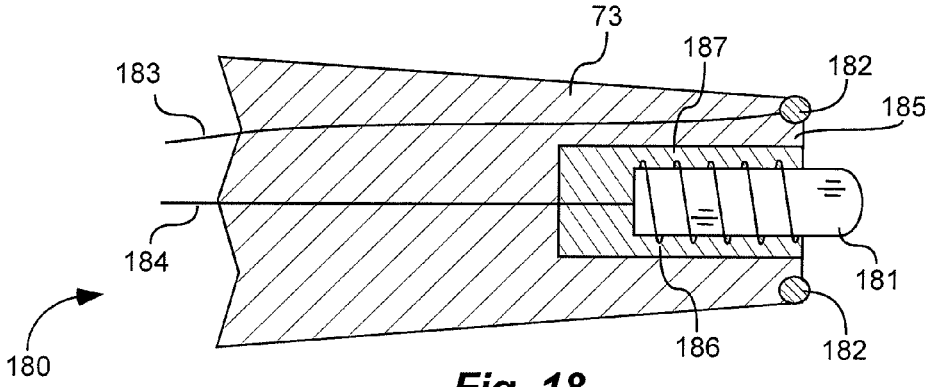
FIG. 18 is a schematic cross-sectional side view of a central spring loaded pin connector and a first ring connector surrounding the pin connector and electrically insulated from the pin connector, in accordance with an embodiment of the present invention.
Figure 19:
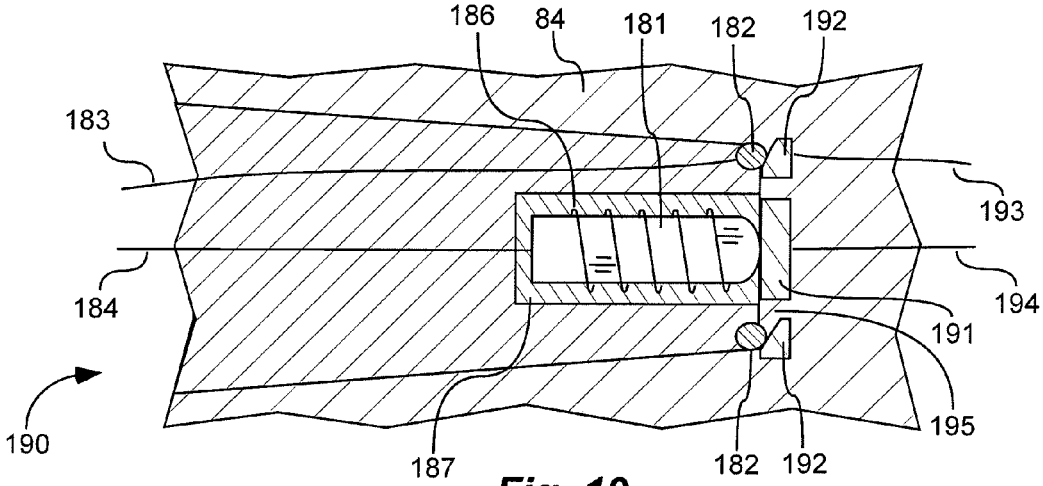
FIG. 19 is a schematic cross-sectional side view of a union of a pin connector and a first ring connector with a plate connector and a second ring connector, in accordance with an embodiment of the present invention.
Figure 20:
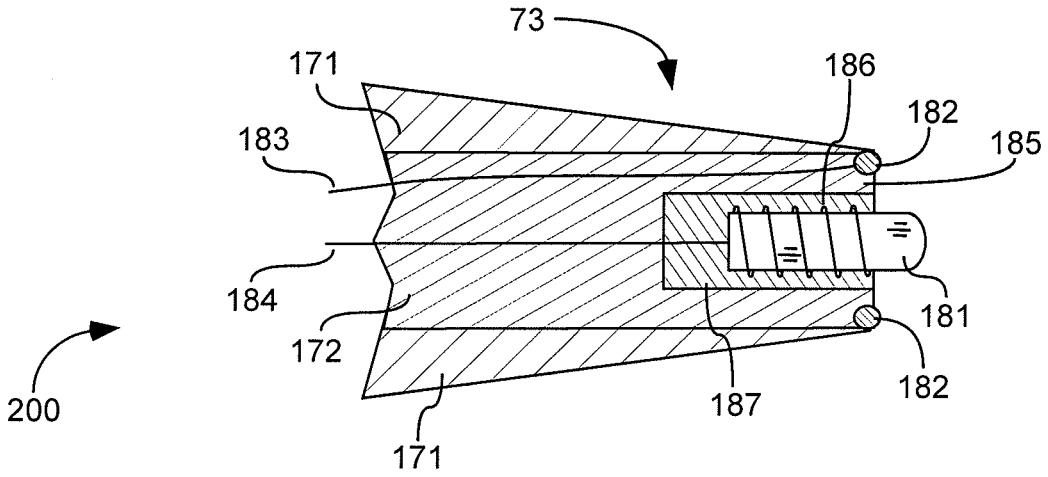
FIG. 20 is a schematic cross-sectional side view of a plug having a core region immediately surrounding a central spring loaded pin connector, an outer region surrounding the core region, and a first ring connector surrounding the pin connector and electrically insulated from the pin connector, in accordance with an embodiment of the present invention.
Figure 21:
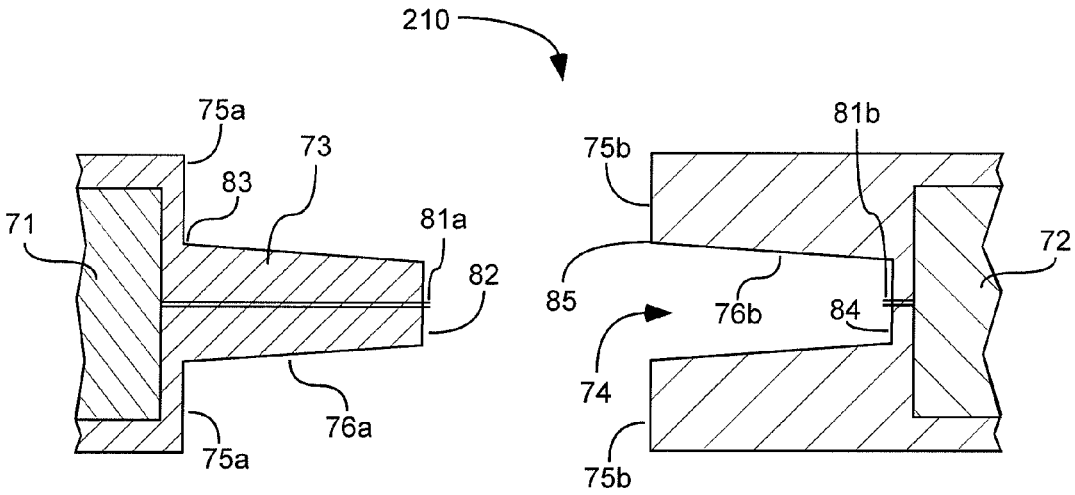
Fig. 21 Prior Art
FIG. 21 is a schematic cross-sectional side view of a connection between a power supply and an x-ray tube, including a plug and a socket, in accordance with the prior art.
Figure 22:
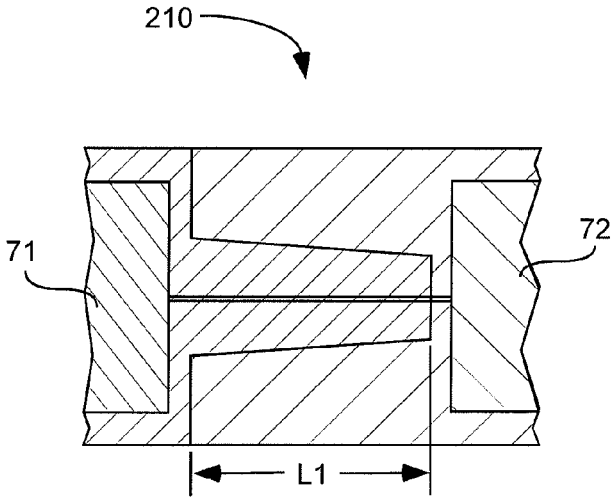
Fig. 22 Prior Art
FIG. 22 is a schematic cross-sectional side view of the connection of FIG. 21, with the power supply and the x-ray tube connected together, in accordance with the prior art.

A coupling 21 can define a junction of the shield 7 and the housing 1. This coupling 21 connection can be rigid and can allow the shield 7 and the x-ray tube 8 to be movable and holdable along with the housing 1 when affixed thereto. The coupling 21 can be separated as shown in FIG. 1. The pair of electrical connections 4 of the power supply 3 can be removably connected to the two electrical connectors 5 of the x-ray tube 8. Such connection 22 can be a socket type connection, with one of the electrical connections 4 or electrical connectors comprising a male-type connector and the other comprising a female-type connector. The electrical connections 4 and the electrical connectors 5 can include a spring-loaded pin-type connector, and a mating plate connector, as shown in FIGS. 18-20, and as described below. The coupling 21 can include a gasket 6 with opposite surfaces 15 compressed between opposing surfaces 16 of the shield 7 and the housing 1.

At least one of the opposing 16 or opposite 15 surfaces can be continuously tapered, forming a continuously radially expanding annular gap with a thinner center and a thicker perimeter prior to coupling the shield 7 to the housing 1, such that when the shield 7 is coupled to the housing 1, the opposing surfaces 16 compress the opposite surfaces 15 of the gasket 6 together, thus minimizing or eliminating air pockets between the opposing 16 and opposite 15 surfaces.

The housing 1 and the shield 7 can both be solid, non-flexible structures and can be fastened together to form a single solid, non-flexible structure, that can be separated and rejoined without damage to the housing 1, the shield 7, or internal components in the housing 1 or the shield 7.

In one embodiment, the housing 1 and the shield 7 can be maintained at ground voltage and the power supply can be configured to provide a voltage differential of at least 10 kilovolts between the cathode 9 and the housing 1 and shield 7.

In one embodiment, either the gasket 6 or the opposing surfaces 16 comprise a soft material and the other comprises a hard material. The soft material can be substantially softer than the hard material. The soft material can be compressed by the hard material when the opposing 16 and opposite 15 surfaces are compressed together, thus minimizing air pockets between the opposing 16 and opposite 15 surfaces. A Durometer Shore A hardness of the hard material divided by a Durometer Shore A hardness of the soft material can be between 1.7 and 2.2 in one embodiment, between 1.5 and 2.4 in another embodiment, or between 1.3 and 2.6. The Durometer Shore A hardness of the soft material can be between 40 and 60 in one embodiment.

Opposing surfaces 16 can be formed as rigid caps 13 disposed in open ends of the housing 1 and/or the shield 7. A mold can be used to make the caps 13. The caps 13 can be made of rubber, silicon, epoxy or other suitable, electrically insulative material. The caps can be a hard material or a soft, flexible and/or elastic material. The caps 13 can be formed while in the housing 1 and/or shield 7; or the caps 13 can be formed separately, then inserted into the housing 1 and/or the shield 7. A liquid electrically insulative potting 2 can then be poured into and fill open areas in the housing 1 and/or shield 2, then allowed to cure or harden. The caps 13 can have a circumferentially corrugated inner surface 14 facing and abutting the potting 2.

Potential arc paths include boundaries such as the inner surface 14 of the caps 13 and the junction of the gasket 6 to the caps 13. The corrugated inner surface 14 of the caps 13 can be a means for resisting arcing along this potential arc path by increasing the distance electrical arc must travel. Continuously tapered opposing 16 or opposite 15 surfaces, compressed together can be another means for resisting arcing along the potential arc path of the junction of the gasket 6 to the caps 13 by minimizing or eliminating air pockets in this junction. The continuously tapered opposing 16 or opposite 15 surfaces, compressed together, are an example of a means for progressively compressing an annular gap oriented perpendicular to the pair of electrical connections in a radial outward direction.

Figure 3A:
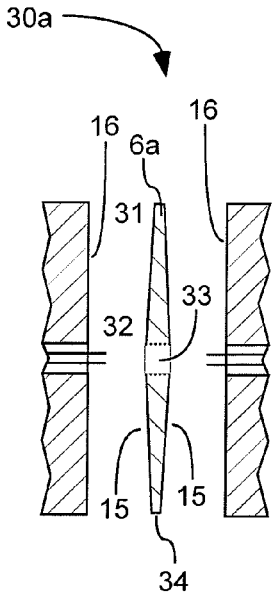
FIGS. 3*a-c* are schematic cross-sectional side views of junctions of x-ray power supplies and x-ray tubes, including tapered gaskets, in accordance with embodiments of the present invention.
Figure 3B:
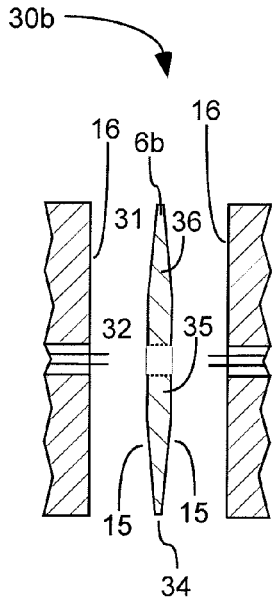
Figure 3C:
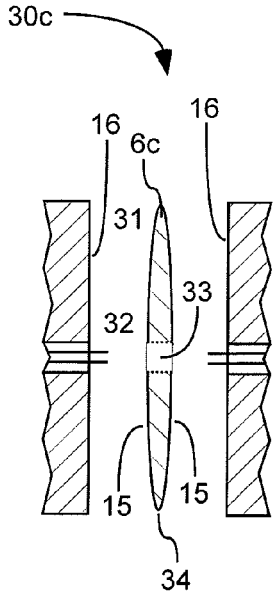

As illustrated by couplings 30*a-c* in FIGS. 3*a-c*, at least one of the opposite surfaces 15 of the gasket 6 can be tapered, allowing for a smaller gap between opposite surfaces 15 and opposing surfaces 16 at the center 32 and a larger gap closer to edges 31. As shown in FIG. 3*a*, the taper can be uniform from a hole 33 in the center of the gasket 6*a* to an outer perimeter 34 of the gasket 6*a*. As shown in FIG. 3*b*, a central section 35 can be uniform in thickness, and an outer section 36 can include a uniform taper from the central section 35 to the outer perimeter 34 of the gasket 6*b*. Gaskets 6*a-b* in FIGS. 3*a-b* are frustoconical-shaped. As shown in FIG. 3*c*, the taper of gasket 6*c* can be rounded.

Figure 4A:
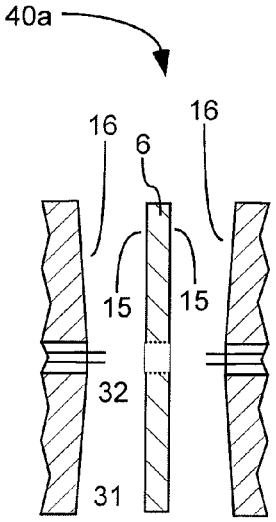
FIGS. 4*a-c* are schematic cross-sectional side views of junctions of x-ray power supplies and x-ray tubes, including tapered opposing surfaces, in accordance with an embodiment of the present invention.
Figure 4B:
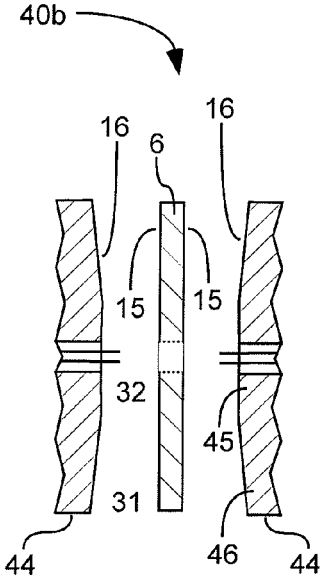
Figure 4C:
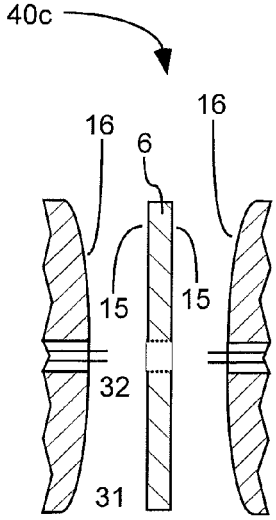

As illustrated by couplings 40*a-c* in FIGS. 4*a-c*, at least one of the opposing surfaces 16 of the shield and/or housing can be tapered, allowing for a smaller gap between opposite surfaces 15 and opposing surfaces 16 at the center 32 and a larger gap closer to edges 31. As shown in FIG. 4*a*, the taper can be uniform from the center 32 to an outer perimeter 31. As shown in FIG. 4*b*, a central section 45 of the opposing surfaces 16 of the shield and/or housing can be uniform in thickness, and an outer section 46 can include a uniform taper from the central section 45 to the outer perimeter 44 of the shield and/or housing. Opposing surfaces 16 in FIGS. 4*a-b* are frustoconical-shaped. As shown in FIG. 4*c*, the taper of the opposing surfaces 16 can be rounded.

In one embodiment, either the opposite surfaces 15 of the gasket 6*a-c* is tapered, as shown in FIGS. 3*a-c*, or opposing surfaces 16 of the shield 7 and/or housing 1 is tapered, as shown in FIGS. 4*a-c*. In another embodiment, opposite surfaces 15 and at least one of the opposing surfaces 16 are tapered, thus combining the gaskets 6*a-c* shown in FIGS. 3*a-c* with tapered opposing surfaces 16 shown in FIGS. 4*a-c*.

Figure 5:
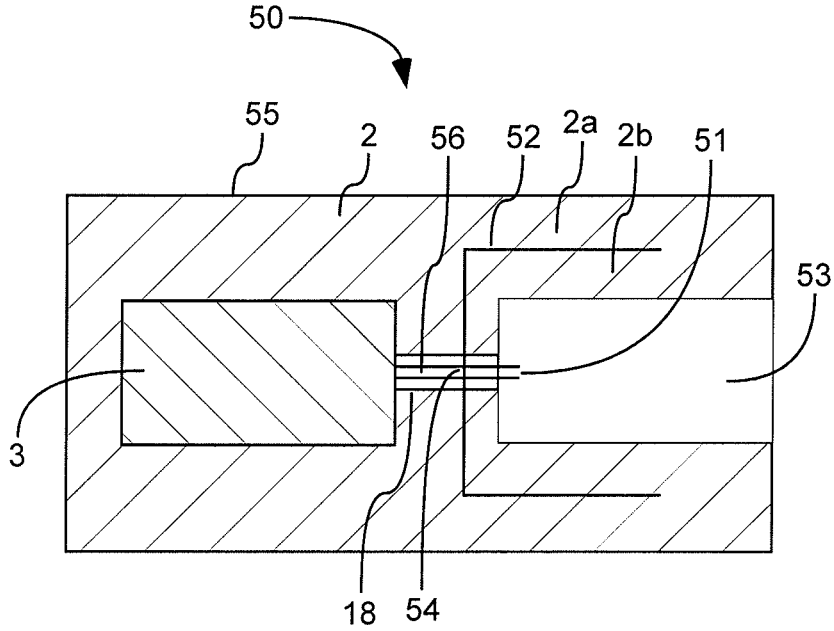
FIG. 5 is a schematic cross-sectional side view of an x-ray power supply, a socket for removably connecting an x-ray tube, and an electrically conductive sleeve configured to resist arcing by reducing or removing a voltage gradient along a potential arc path, in accordance with an embodiment of the present invention.

Shown in FIG. 5, is a power source 50 for an x-ray tube comprising a housing 55 containing a power supply 3. The power supply 3 includes a pair of electrical connections 56 configured to provide electrical power to an x-ray tube. The electrical connections 56 can be wires that are enclosed in a case or tube 18. The case 18 can be electrically conductive and can be electrically connected to one of the electrical connections 56.

The housing 55 can contain a socket 53 at one end of the housing 55. The socket 53 can be formed by electrically insulative potting 2 inside the housing 55. The socket 53 can be configured for insertion and removal of an x-ray tube (8 in FIG. 6). The socket 53 can include the pair of electrical connections 56 of the power supply 3 at a bottom of the socket 51.

An electrically conductive sleeve 52 can be embedded in the potting 2. Potting 2*a* can be disposed between the sleeve 52 and the housing 55, to electrically insulate the sleeve 52 from the housing 55. Potting 2*b* can be disposed between the sleeve 52 and the socket 53. The sleeve 52 can circumscribe at least a portion of the socket 53. The sleeve 52 can be electrically coupled to one of the pair of electrical connections 56 of the power supply 3.

Figure 6:
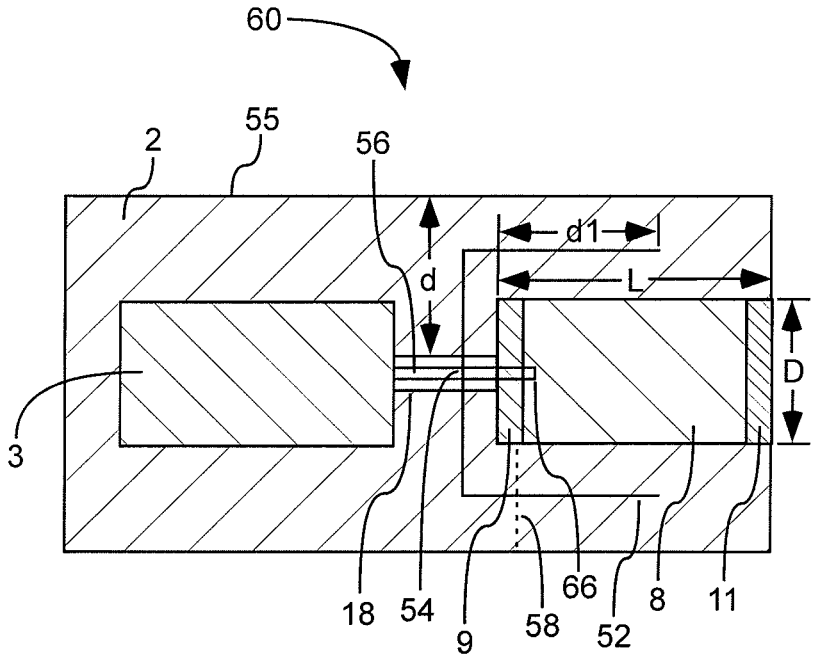
FIG. 6 is a schematic cross-sectional side view of an x-ray power supply, an x-ray tube removably connected to the power supply, and an electrically conductive sleeve configured to resist arcing by reducing or removing a voltage gradient along a potential arc path, in accordance with an embodiment of the present invention.

As shown in FIG. 6, x-ray source 60 can include an x-ray tube 8 inserted into the socket 53. Electrical connectors on the x-ray tube can be removably, electrically connected to the pair of electrical connections 56 of the power supply 3. Such connection can be a socket type connection, with connectors from the x-ray tube 8 or power supply 3 comprising a male-type connector and the other comprising a female-type connector. The electrical connections 56 and the electrical connectors on the x-ray tube can include a spring-loaded pin-type connector, and a mating plate connector, as shown in FIGS. 18-20, and as described below. Thus, the x-ray tube 8 can be removably affixed to the housing 55 in a rigid manner with the x-ray tube 8 movable and holdable along with the housing 55 when affixed thereto.

The sleeve 52 can be a means for resisting arcing along the potential arc path, namely between the x-ray tube 8, or especially the cathode 9, or electrical connections to the cathode 9, and the housing 55. Because the device is configured for x-ray tube insertion and removal into the sleeve 53, air pockets are likely formed between the x-ray tube 8 and potting 2. As described previously, large voltages across such air pockets can cause arcing across the air pocket and ionization of the air, which can result in potting breakdown.

With the x-ray source 60 design of the present invention, however, the sleeve 52 will be maintained at approximately the same voltage as the cathode 9, thus, there will be minimal voltage gradients, if any, between the x-ray tube 8 at or near the cathode 9 and the sleeve 52, and thus minimal voltage gradients across air pockets between tube 8 and potting 2 in this region. There will be, of course, a very large voltage between the sleeve 52 and the housing 55. It will be easier to avoid air pockets between sleeve 52 and housing 55, and thus easier to provide effective electrical insulation between sleeve 52 and housing 55, because the sleeve 52, unlike the x-ray tube 8, will not be inserted and removed, but is rather permanently affixed in the potting 8 of the housing 55. Thus, the sleeve 52, or electrode, can act as a means for resisting arcing along the potential arc path, namely between the cathode 9, or other high voltage components of the x-ray tube 8, and the housing 55, by reducing or removing a voltage gradient along this potential arc path 58.

Because the sleeve 52 can be maintained at approximately the same voltage as the cathode 9, there can be minimal or no chance of arcing between the sleeve 52 and the cathode 9 or x-ray tube near the cathode 9. There can be, however, an increasing voltage differential between the sleeve 52 and the x-ray tube progressing closer to the anode 11, thus increasing the risk of arcing between the tube 8 and the sleeve 52 nearer the anode 11. Therefore, typically the sleeve 52 will not extend all the way to the end of the housing 55 at the anode end, but rather will only surround part of the socket 53 and thus part of the x-ray tube 8.

A balance in the design may be made between protecting against arcing between the tube 8 and the sleeve 52, if the sleeve 52 extends too far towards the anode 11, or between tube 8 and the housing 55, if the sleeve 52 is too short. This balance may be made depending on cathode 9 to anode 11 voltage differential and thickness of potting 2. The sleeve 52 can surround the x-ray tube 8 between 5% to 25% of a length L of the x-ray tube 8 in one embodiment ($0.05<d1/L<0.25$); between 24% to 50% of a length L of the x-ray tube 8 in another embodiment ($0.24<d1/L<0.50$); between 49% to 75% of a length L of the x-ray tube 8 in another embodiment ($0.49<d1/L<0.75$); or between 24% to 75% of a length L of the x-ray tube 8 in another embodiment ($0.24<d1/L<0.75$).

The potting 2 can be flexible and elastic and the x-ray tube 8 can be press-fit into the potting 2 of the socket 53. Flexible and elastic potting 2 can allow for a tighter fit and less air pockets between x-ray tube 8 and potting 2.

Figure 7:
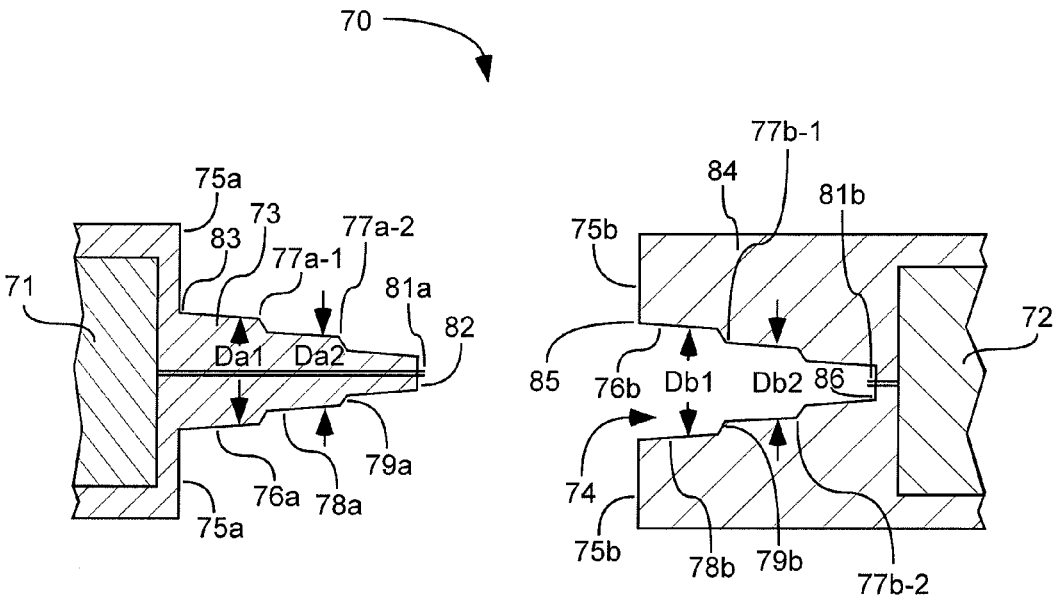
FIG. 7 is a schematic cross-sectional side view of a connection between a power supply and an x-ray tube, including a plug and a socket and a non-linear cross-sectional profile of the plug and the socket, in accordance with an embodiment of the present invention.

Illustrated in FIG. 7 is a coupling 70 between a power supply and an x-ray tube for electrically, physically and releasably coupling the two together. The coupling 70 can comprise a plug 73 extending from one of the power supply or the x-ray tube and a socket 74 extending in towards the other of the power supply or the x-ray tube. A plug annular surface 75*a* can surround the plug 73 at a base 83 thereof and a socket annular surface 75*b* can surround the socket 74 at a leading edge 85 thereof.

The plug 73 can have a tapered surface 76*a* and a continuously reduced diameter Da from the base 83 towards an end 82 of the plug 73 (e.g. Da1>Da2). The socket 74 can have a tapered surface 76*b* and a continuously reduced diameter Db from the leading edge 85 towards a bottom 86 of the socket 74 (e.g. Db1>Db2).

Shown are two devices 71 and 72, one of which can be the x-ray tube and the other can be the power supply. One of the devices (the "plug device" 71) can be attached to a plug 73. The other device (the "socket device" 72) can be attached to a socket 74. In one embodiment, the x-ray tube can be the plug device 71 and the power supply can be the socket device 72. In another embodiment, the x-ray tube can be the socket device 72 and the power supply can be the plug device 71.

Electrical connectors 81*a* can be associated with the plug ("plug connectors" 81*a*). The plug connectors 81*a* can be electrically connected to the plug device 71. Electrical connectors 81*b* can be associated with the socket ("socket connectors" 81*b*). The socket connectors 81*b* can be electrically connected to the socket device 72. The plug connectors 81*a* can mate with the socket connectors 81*b* and can connect when the plug 73 is inserted into the socket 74. The electrical connectors 81*a-b* can allow electrical current to flow between the plug device 71 and the socket device 72, or in other words, from the power supply to the tube when connected. The plug connectors 81*a* can be disposed at the end 82 of the plug 73 and the socket connectors 81*b* can be disposed at the bottom 86 of the socket 74. It can be beneficial to have the connectors 81 disposed at the end 82 of the plug 73 and at the bottom 86 of the socket 74 in order to maximize distance along the junction of the plug and socket, between the connection and an external grounded structure, thus minimizing the chance of arcing.

The tapered surfaces 76 and/or the annular surfaces 75 can have a non-linear cross-sectional profile. The tapered surfaces 76 and the annular surfaces 75 of the plug 73 and the socket 74 can substantially mate. The plug 73 can be inserted into and be received by the socket 74. The plug 73 and materials 84 forming the socket 74 can comprise elastic, electrically insulative material. The plug 73 can be formed of the same, or of different, elastic, electrically insulative material than the materials 84 forming the socket 74.

The tapered surfaces 76 can abut one another when the x-ray tube and the power supply are coupled together. In one embodiment, the annular surfaces 75 can also abut one another when the x-ray tube and the power supply are coupled together. In another embodiment, an air gap, a washer, or a gasket, can exist between the annular surfaces 75 when the x-ray tube and the power supply are coupled together.

The non-linear cross-sectional profile can include a stepped profile on the tapered surface 76*a* of the plug 73. For example, the tapered surface of the plug 73 can include one step (not shown in the figures), two steps 77*a*-1 and 77*a*-2 as shown on coupling 70 in FIGS. 7-8, three steps 77*a*-1, 77*a*-2, and 77*a*-3 as shown on coupling 90 in FIG. 9, or more than three steps (not shown in the figures). Each plug step 77*a* can include an abrupt reduction in plug diameter Da. The steps 77*a* of the plug can include longitudinal segments 78*a* and radial segments 79*a*.

The non-linear cross-sectional profile can include a stepped profile on the tapered surface 76*b* of the socket 74. For example, the tapered surface of the socket 74 can include one step (not shown in the figures), two steps 77*b*-1 and 77*b*-2 as shown on coupling 70 in FIGS. 7-8, three steps 77*b*-1, 77*b*-2, and 77*b*-3 as shown on coupling 80 in FIG. 9, or more than three steps (not shown in the figures). Each socket step 77*b* can include an abrupt reduction in socket diameter Db. The steps 77*b* of the socket can include longitudinal segments 78*b* and radial segments 79*b*.

The stepped profile on the tapered surface 76*a* of the plug 73 can substantially mate with the stepped profile on the tapered surface 76*b* of the socket 74. For example, plug step 77*a*-1 can mate with socket step 77*b*-1 and plug step 77*a*-2 can mate with socket step 77*b*-2. The coupling 70 of FIG. 7, between the power supply and the x-ray tube, are shown coupled together in FIG. 8, with the plug tapered surface 76*a* mating with the socket tapered surface 76*b*.

Figure 9:
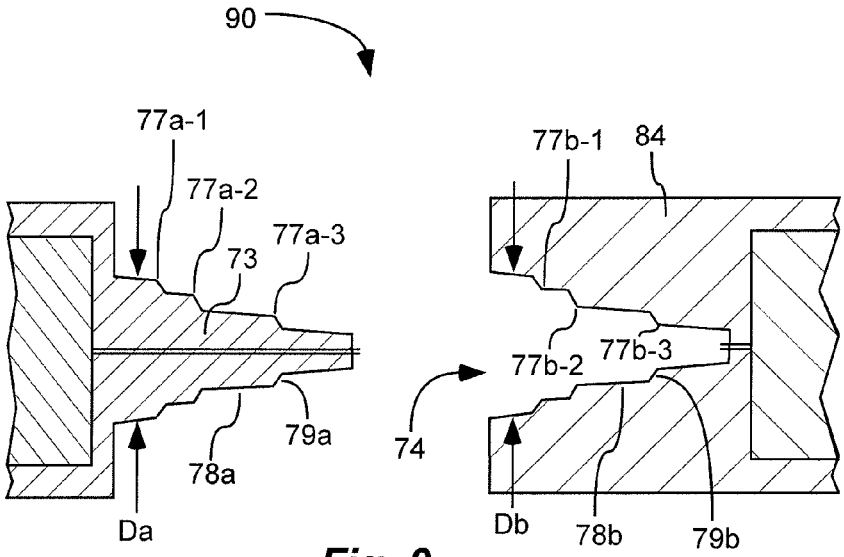
FIG. 9 is a schematic cross-sectional side view of a connection between a power supply and an x-ray tube, including a plug and a socket and a non-linear cross-sectional profile of the plug and the socket, in accordance with an embodiment of the present invention.

As shown on coupling 90 in FIG. 9, the plug 73 can have a diameter Da and the socket 74 can have a diameter Db at a mating location. The diameter Da of the plug 73 can be oversized to allow contact between longitudinal segments 78 of the plug 73 and the socket 74 before contact between radial segments 79 of the plug 73 and the socket 74, when coupling the power supply and the x-ray tube together. In other words, the socket 74 can be press fit or interference fit with the plug 73 having a lateral width or diameter Da greater than a corresponding lateral width or diameter Db of the socket 74 at corresponding locations along a longitudinal length $L_P$ (see FIG. 10) thereof.

The diameter Da of the plug can be between 1.004 to 1.006 times larger than the diameter of the socket Db at mating locations in one embodiment, or between 1.0045 to 1.0055 times larger than the diameter of the socket Db at mating locations in another embodiment. For example, for the diameter Da of the plug 1.005 times larger than the diameter of the socket Db, if socket diameter is 10 mm, then plug diameter can be 10.05 mm at a mating location. Over sizing plug diameter Da, in order to first allow contact between longitudinal segments 78, can result in less air trapped in the junction of the plug 73 and the socket 74. For applications in which the x-ray source may be exposed large variation in temperature, or temperature extremes, it may be important to select materials to form the plug and socket that have a low coefficient of thermal expansion, in order to ensure proper fit at all operating temperatures.

Figure 10:
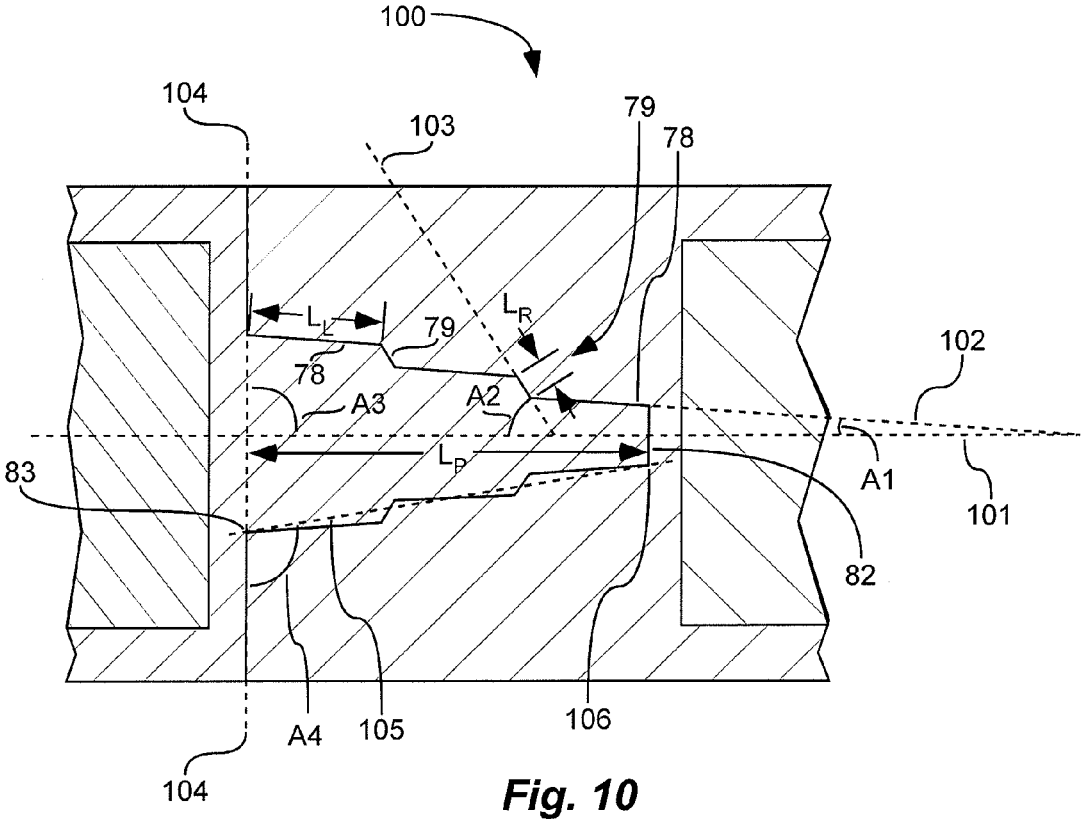
FIG. 10 is a schematic cross-sectional side view of a connection between a power supply and an x-ray tube, including a plug and a socket, in accordance with an embodiment of the present invention.

Shown on coupling 100 in FIG. 10 are plug centerline 101, longitudinal segment line 102 (line that is parallel with longitudinal segments 78) and radial segment line 103 (line that is parallel with radial segments 79). A first angle A1 is defined as the angle between the plug centerline 101 and the longitudinal segment line 102. A second angle A2 is defined as an angle between the plug centerline 101 and the radial segment line 103. The first angle A1 can be smaller than the second angle A2. The second angle A2 minus the first angle A1 can be between 45 degrees and 80 degrees in one embodiment, or between 55 degrees and 75 degrees in another embodiment.

Shown on coupling 100 in FIG. 10 are lengths $L_L$ of longitudinal segments 78 and lengths $L_R$ of radial segments 79. Lengths $L_L$ of longitudinal segments 78 can be at least two times longer than lengths $L_R$ of radial segments in one embodiment, or at least three times longer than lengths $L_R$ of radial segments in another embodiment.

As shown in FIG. 10, an angle A4 between a plane of the plug annular surface 104 and a line between the base 83 of the plug 73 and the a corner 106 of the end 82 of the plug 73 can be between 92 and 105 degrees in one embodiment or between 93 and 98 degrees in another embodiment. A plane 104 of the plug and socket annular surfaces 75 can be substantially perpendicular to a centerline 101 of the plug 73 and the socket 74.

Figure 11:
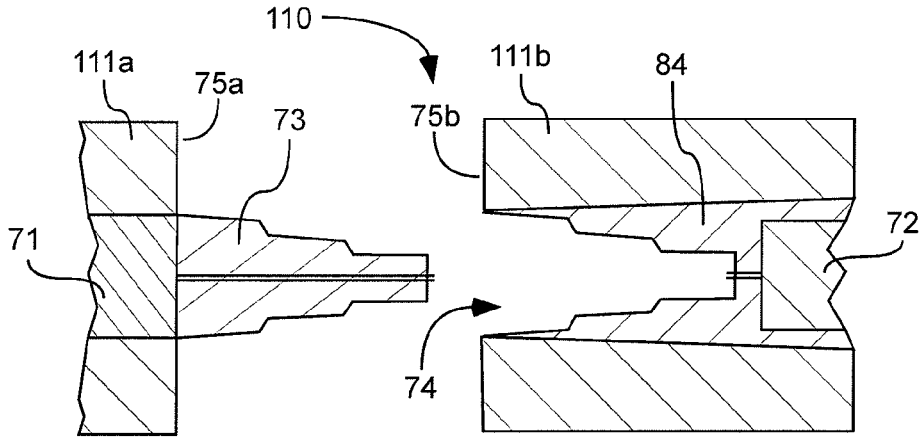
FIG. 11 is a schematic cross-sectional side view of a connection between a power supply and an x-ray tube, including a plug and a socket, with annular surfaces having a different material than the plug, in accordance with an embodiment of the present invention.

As shown in FIG. 11, the annular surfaces 75*a*-*b* can be formed of a different material 111 than the plug 73 and/or the material forming the socket 84. The plug annular surface 75*a* and the socket annular surface 75*b* can be formed of the same material (111*a*=111*b*) or of different materials (111*a*≠111*b*). The annular surfaces 75*a*-*b* can be formed of a hard metallic material and can be used for bolting the plug 73 and socket together. The annular surfaces can comprise elastic, electrically insulative material. In another embodiment, the plug annular surface 75*a* can be formed of the same material as the plug (material of 111*a*=material of 73) and/or the socket annular surface 75*b* can be formed of the same material as the material forming the socket (material of 111*b*=material of 84).

Figure 12:
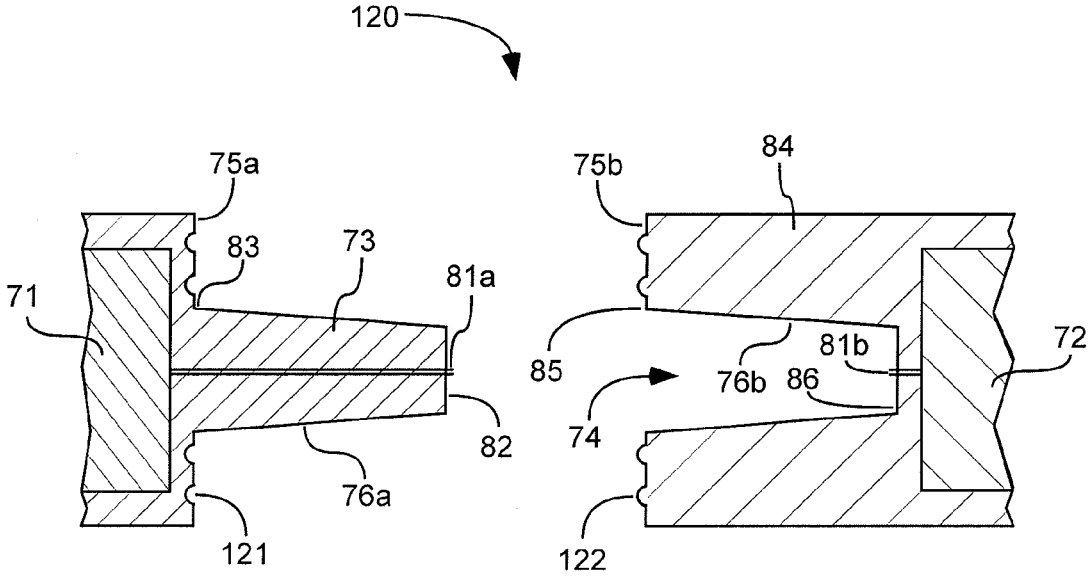
FIG. 12 is a schematic cross-sectional side view of a connection between a power supply and an x-ray tube, including a plug and a socket having a non-linear cross-sectional profile of an annular surface at a base of the plug and at a leading edge of the socket, in accordance with an embodiment of the present invention.
Figure 13:
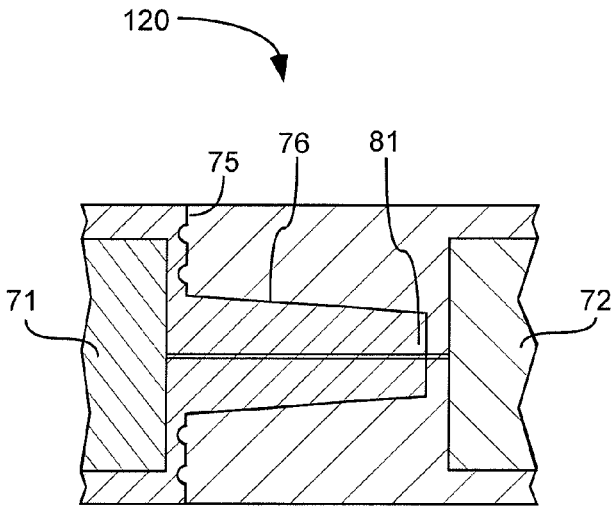
FIG. 13 is a schematic cross-sectional side view of the connection of FIG. 12, with the power supply and the x-ray tube connected together, in accordance with an embodiment of the present invention.
Figure 14:
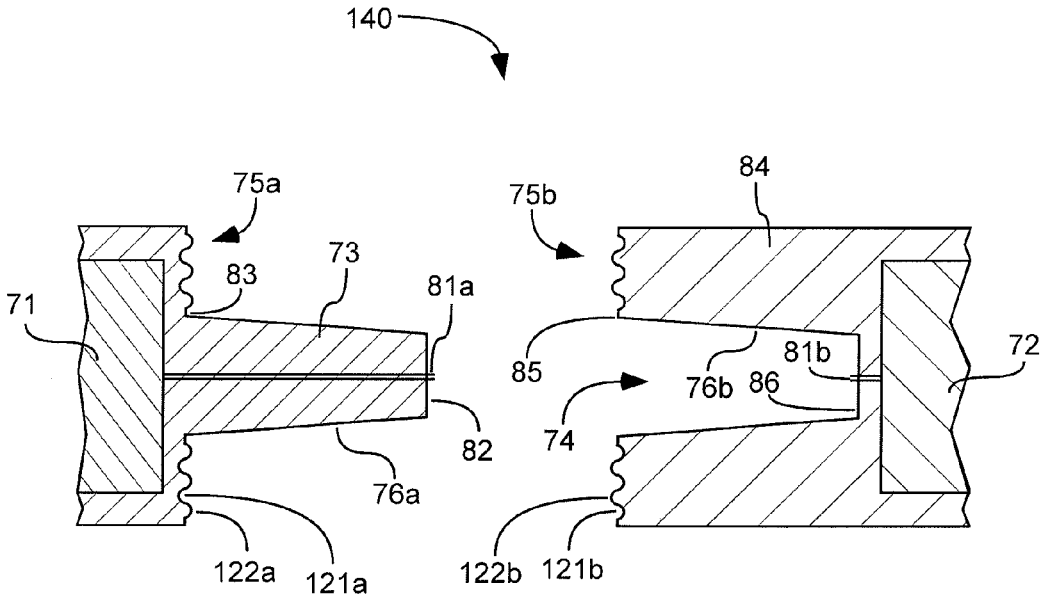
FIG. 14 is a schematic cross-sectional side view of a connection between a power supply and an x-ray tube, including a plug and a socket having a non-linear cross-sectional profile of an annular surface at a base of the plug and at a leading edge of the socket, in accordance with an embodiment of the present invention.

As shown on connectors 120 and 140 in FIGS. 12-14, the annular surfaces 75 can have a non-linear cross-sectional profile. As shown in FIG. 13, the annular surfaces 75 can abut one another when coupled. The non-linear cross-sectional profile of the plug annular surface 75*a* can mate with the socket annular surface 75*b* when coupled.

The annular surfaces 75 non-linear cross-sectional profile can include annular grooves 121 on one of the plug annular surface 75*a* or the socket annular surface 75*b* and mating annular ridges 122 on the other of the plug annular surface 75*a* or the socket annular surface 75*b*. As shown in FIGS. 12-13, annular grooves 121 can be disposed on the plug annular surface 75*a* and mating annular ridges 122 can be disposed on the socket annular surface 75*b*. The opposite configuration, of annular grooves 121 disposed on the socket annular surface 75*b* and the mating annular ridges 122 disposed on the plug annular surface 75*a*, is also within the scope of the present invention.

The non-linear cross-sectional profile of the annular surfaces 75 can include (1) annular grooves 121*a* on the plug annular surface 75*a* and mating annular ridges 122*b* on the socket annular surface 75*b*; and (2) annular grooves 121*b* on the socket annular surface 75*b* and mating annular ridges 122*a* on the plug annular surface 75*a*. The non-linear cross-sectional profile of the plug annular surface 75*a* can mate with the socket annular surface 75*b* when coupled.

Figure 15:
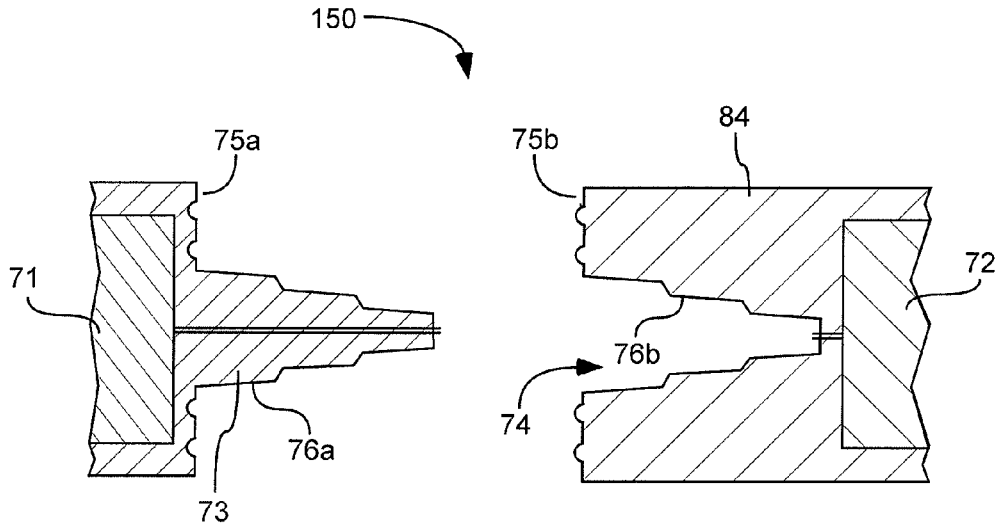
FIG. 15 is a schematic cross-sectional side view of a connection between a power supply and an x-ray tube, including a plug and a socket having a non-linear cross-sectional profile of the plug and the socket and a non-linear cross-sectional profile of an annular surface at a base of the plug and at a leading edge of the socket, in accordance with an embodiment of the present invention.

As shown on connector 150 FIG. 15, both the annular surfaces 75 and the tapered surfaces 76 can have a non-linear cross-sectional profile. The non-linear cross-sectional profiles can mate when the plug 73 is coupled with the socket 74.

FIGS. 7-16 show both a plug 73 and a socket 74 used for coupling an x-ray tube or a power supply. The present invention can include one of these devices (x-ray tube or a power supply), with a plug or socket, configured to mate with the other.

Figure 16:
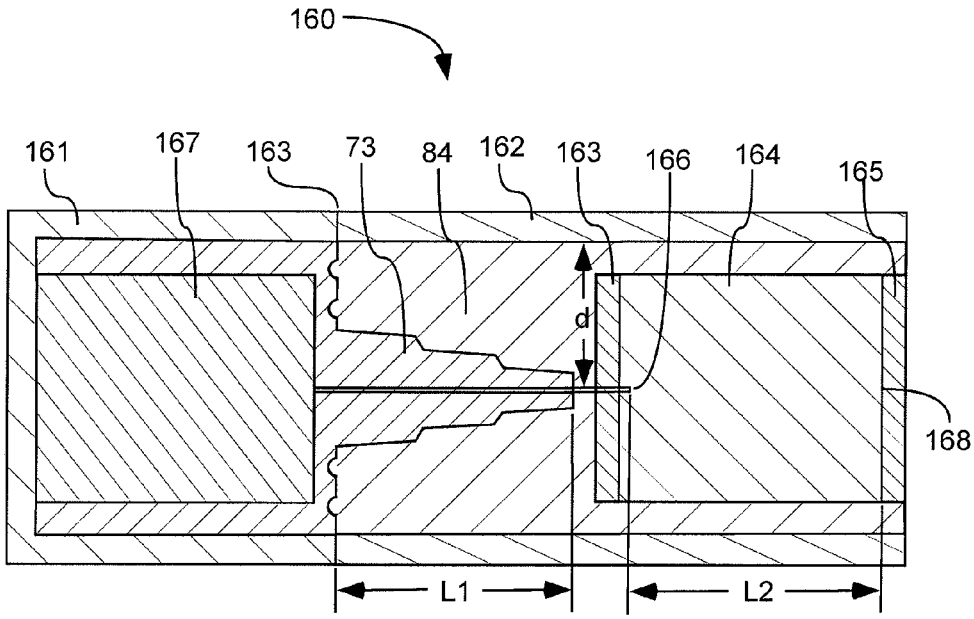
FIG. 16 is a schematic cross-sectional side view of a power supply and an x-ray tube removably joined together, including a plug and a socket having a non-linear cross-sectional profile of the plug and the socket and/or a non-linear cross-sectional profile of an annular surface at a base of the plug and a leading edge of the socket, a housing surrounding the power supply, a shield surrounding the x-ray tube, the housing and shield removably joined together, in accordance with an embodiment of the present invention.

In one embodiment, a coupling device on a power supply (for example device 71 in FIG. 7) can comprise a plug 73 extending from the power supply. The plug 73 can have a tapered surface 76*a* and a continuously reduced diameter Da. An annular surface 75*a* can surround the plug 73 at a base 83. The tapered surface 76*a* (as shown in FIGS. 7-11), the annular surface 75*a* (as shown in FIGS. 12-14), or both (as shown in FIGS. 15-16), can have a non-linear cross-sectional profile and can be configured to mate with a non-linear cross-sectional profile of a socket 74 extending in towards an x-ray tube (for example device 72 in FIG. 7). The plug 73 can comprise elastic, electrically insulative material. Electrical connectors 81*a* can be associated with the plug 73. The electrical connectors 81*a* can be configured to allow electrical current to flow from the power supply to the tube when connected.

In another embodiment, a coupling device on a power supply (for example device 72 in FIG. 7) can comprise a socket 74 extending in towards the power supply. The socket 74 can have a tapered surface 76*b* and a continuously reduced diameter Db. An annular surface 75*b* can surround the socket 74 at a leading edge 85. The tapered surface 76*b* (as shown in FIGS. 7-11), the annular surface 75*b* (as shown in FIGS. 12-14), or both (as shown in FIGS. 15-16), can have a non-linear cross-sectional profile and can be configured to mate with a non-linear cross-sectional profile of a plug 73 extending from an x-ray tube (for example device 71 in FIG. 7). The socket 74 can comprise elastic, electrically insulative material. Electrical connectors 81*b* can be associated with the socket 74. The electrical connectors 81*b* can be configured to allow electrical current to flow from the power supply to the tube when connected.

In another embodiment, a coupling device on an x-ray tube (for example device 71 in FIG. 7) can comprise a plug 73 extending from the x-ray tube. The plug 73 can have a tapered surface 76*a* and a continuously reduced diameter Da. An annular surface 75*a* can surround the plug 73 at a base 83. The tapered surface 76*a* (as shown in FIGS. 7-11), the annular surface 75*a* (as shown in FIGS. 12-14), or both (as shown in FIGS. 15-16), can have a non-linear cross-sectional profile and can be configured to mate with a non-linear cross-sectional profile of a socket 74 extending in towards a power supply (for example device 72 in FIG. 7). The plug 73 can comprise elastic, electrically insulative material. Electrical connectors 81*a* can be associated with the plug 73. The electrical connectors 81*a* can be configured to allow electrical current to flow from the power supply to the tube when connected.

In another embodiment, a coupling device on an x-ray tube (for example device 72 in FIG. 7) can comprise a socket 74 extending in towards the x-ray tube. The socket 74 can have a tapered surface 76*b* and a continuously reduced diameter Db. An annular surface 75*b* can surround the socket 74 at a leading edge 85. The tapered surface 76*b* (as shown in FIGS. 7-11), the annular surface 75*b* (as shown in FIGS. 12-14), or both (as shown in FIGS. 15-16), can have a non-linear cross-sectional profile and can be configured to mate with a non-linear cross-sectional profile of a plug 73 extending from an x-ray tube (for example device 71 in FIG. 7). The socket 74 can comprise elastic, electrically insulative material. Electrical connectors 81*b* can be associated with the socket 74. The electrical connectors 81*b* can be configured to allow electrical current to flow from the power supply to the tube when connected.

As shown in FIG. 16, x-ray source 160 can be configured for the power supply 167 to provide, and for the x-ray tube 164 to be operated at, a voltage of at least 9 kilovolts in one embodiment, at least 39 kilovolts in another embodiment, or at least 79 kilovolts in another embodiment, between a cathode 163 and an anode 165 of the x-ray tube 164.

Electron flight distance EFD, defined as a distance L2 from the electron emitter 166 to the target 168, can be an indication of overall tube size. It can be desirable in some circumstances, especially for miniature, portable x-ray tubes, to have a short electron flight distance EFD. The electron flight distance EFD can be less than 1 inch in one embodiment, less than 0.8 inches in one embodiment, less than 0.7 inches in another embodiment, less than 0.6 inches in another embodiment, less than 0.4 inches in another embodiment, or less than 0.2 inches in another embodiment. A distance L1 from a plane (104 in FIG. 10) of the plug annular surface 75*a* along a centerline (101 in FIG. 10) of the plug 73 to the end 82 of the plug can be less than 30 millimeters.

The power supply 167 can include a housing 161 and the x-ray tube 164 can include a shield 162. Both the housing 161 and the shield 164 can be solid, non-flexible structures (metallic for example) that are capable of being fastened together to form a single solid, non-flexible structure, and that are configured to be separated and rejoined without damage to the housing 161, the shield 164, or internal components (e.g. x-ray tube 164, power supply 167, plug 73, material 84 forming the socket 74, annular surfaces 75, etc.) in the housing 167 or the shield 164. The housing 167 and the shield 164 can be maintained at ground voltage. The power supply 167 can be configured to provide a voltage differential of at least 9 kilovolts between the cathode 163 in the x-ray tube 164 and the housing 161 and shield 162.

In FIG. 16, the plug 73 is shown extending from the power supply 167, and the socket is shown extending in towards the x-ray tube 164. The opposite configuration, with the plug 73 is extending from the x-ray tube 164, and the socket extending in towards the power supply 167 is also within the scope of this invention. Also, shown in FIG. 16, both the tapered surfaces 76 and the annular surfaces 75 have non-linear profiles. An embodiment with either the tapered surfaces 76, or the annular surfaces 75, but not both, having non-linear profiles, is also within the scope of this invention.

Figure 17:
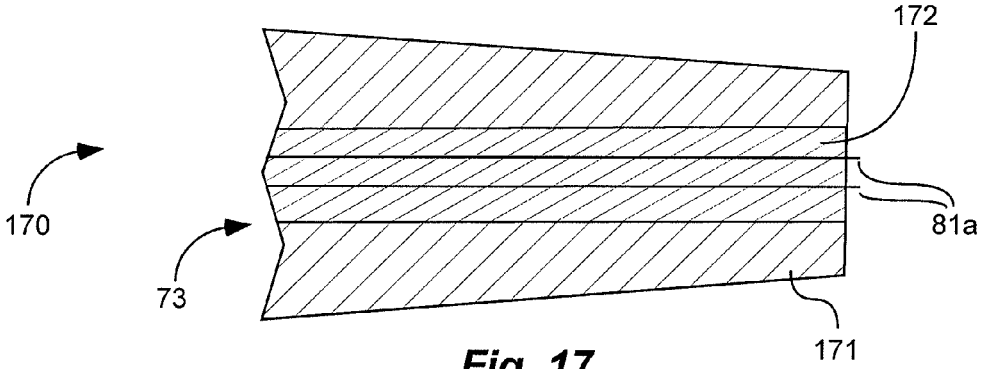
FIG. 17 is a schematic cross-sectional side view of a plug having a core region immediately surrounding electrical connectors and an outer region surrounding the core region, in accordance with an embodiment of the present invention.

Shown in FIG. 17 is a cross sectional view of an end 170 of a plug 73. The plug 73 can comprise a core region 172 immediately surrounding the plug connectors 81*a*. The plug connectors 81*a* can include a portion that mates with the socket connectors 81*b*, and wires for conducting electrical current to the power supply or x-ray tube. The core region 172 can surround a portion of the plug connectors, such as the wires, and can leave an open section for allowing electrical contact with the socket connectors 81*b*. An outer region 171 can surround, or immediately surround, the core region 172. Although only the end 170 of the plug is shown in FIG. 17, the entire plug 73 can have this configuration with a central core region 172 and an outer region 171.

The core region 172 can comprise a relatively stiffer or harder material to aid in plug 73 insertion into the socket 74 with reduced bending. The outer region 171 can comprise a relatively softer material to improve contact between the plug 73 and the material 84 forming the socket 74. The material 84 forming the socket 74 can also comprise a relatively softer material to improve contact between the plug 73 and the material 84 forming the socket 74. A Durometer Shore A hardness of the core region 172 divided by a Durometer Shore A hardness of the outer region 171 can be between 1.7 and 2.2 in one embodiment, between 1.5 and 2.4 in another embodiment, or between 1.3 and 2.6. A Durometer Shore A hardness of the material 84 forming the socket 74 divided by the Durometer Shore A hardness of the outer region 171 can be between 0.95 and 1.05. The Durometer Shore A hardness of the outer region 171 can be between 40 and 60 in one embodiment. The outer region can comprise silicone, such as Dow Corning Sylgard® 170. A Durometer Shore A hardness of the annular surfaces 75 can be between 40 and 60 in one embodiment.

Pin connectors are shown in FIGS. 18-20. The mating electrical connectors 81 can include a spring-loaded pin-type connector for easier connection. The pin-type connectors can also allow rotation of the plug 73 and socket 74, for proper alignment, after connection of the two devices.

Pin connector 180 of FIG. 18 includes a central spring 186 loaded pin connector 181 and a first ring connector 182 surrounding the pin connector 181. The first ring connector 182 can be electrically insulated from the pin connector 181. The spring 186 loaded pin connector 181 can be disposed in a housing 187. One electrical wire 184 can be connected between the pin connector 181 and the power supply or x-ray tube and another electrical wire 183 can be connected between the first ring connector 182 and the power supply or x-ray tube.

The pin connector 180 of FIG. 18 is shown disposed in a plug 73. Although not shown in the figures, the pin connector can be associated with the socket 74. Electrical connectors associated with the other of the plug 73 or the socket 74 can including a plate connector 191 and a second ring connector 192. The plate connector 191 can be electrically insulated from the second ring connector 192. One electrical wire 194 can be connected between the plate connector 191 and the power supply or x-ray tube and another electrical wire 193 can be connected between the second ring connector 192 and the power supply or x-ray tube. The pin connector 181 can electrically contact the plate connector 191 and the first ring connector 182 can electrically contact the second ring connector 192 when the plug 73 and the socket 74 are coupled together. As shown in FIG. 20, the spring 186 loaded pin connector 181 can be combined with a relatively stiffer or harder core region 172 and relatively softer outer region 171.

The present invention can include an x-ray tube removably affixed to a power supply in a rigid manner with the x-ray tube movable and holdable along with the power supply when affixed thereto. A releasable coupling between the x-ray tube and the power supply can create an interface defining a potential arc path. The present invention can include a means for resisting arcing along the potential arc path.

In one embodiment, shown in FIG. 6, the means for resisting arcing can include reducing a voltage gradient along a potential arc path by use of an electrically conductive sleeve 52 embedded in flexible, elastic electrically insulative material 2. The sleeve 52 can electrically connect with an electron emitter 66 in the x-ray tube 8. The sleeve 52 can partially surround a socket 53 into which the x-ray tube 8 is inserted. The material 2 forming the socket 53 can be comprised of flexible, elastic electrically insulative material.

In another embodiment, shown in FIGS. 1-2, the means for resisting arcing can include a means for progressively compressing an annular gap oriented perpendicular to the electrical connectors 4-5 in a radial outward direction.

Figure 8:
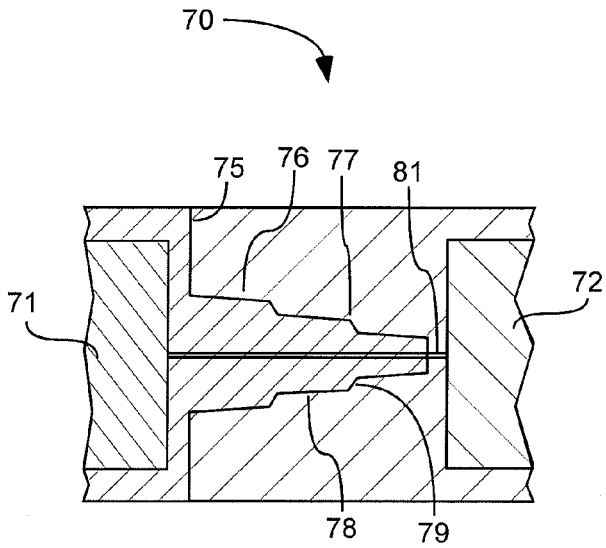
FIG. 8 is a schematic cross-sectional side view of the connection of FIG. 7, with the power supply and the x-ray tube connected together, in accordance with an embodiment of the present invention.

In another embodiment, shown in FIG. 7-9, the means for resisting arcing can include a coupling between the power supply and the x-ray tube, the coupling comprising a plug 73 extending from one of the power supply or the x-ray tube and a socket 74 extending in towards the other of the power supply or the x-ray tube. The plug 73 can have a tapered surface **76*a* and a continuously reduced diameter Da from a base 83 towards an end 82 of the plug 73. The socket 74 can have a tapered surface 76*b* and a continuously reduced diameter Db from a leading edge 85 towards a bottom 86 of the socket 74. The tapered surfaces 76 can have a non-linear profile. The plug 73 and the socket 74 can have substantially mating tapered surfaces 76 with the plug 73 insertable and receivable in the socket 74. The plug 73 and material forming the socket 74** can comprise elastic, electrically insulative material.

The various x-ray source embodiments described herein can be used for portable x-ray sources, which include small x-ray tubes configured to provide a very large voltage differential between the cathode 9 and the anode 11. For example, "small x-ray tube" can mean an x-ray tube 8 with a diameter D of a largest component (anode 11, cathode 9, or insulative cylinder) that is less than one inch and a length L that is less than two inches. A voltage differential, provided by the power supply 3, between cathode 9 and anode 11 of the x-ray tube 8 can be at least 20 kilovolts in one embodiment, at least 30 kilovolts in another embodiment, or at least 50 kilovolts in another embodiment.

Furthermore, various embodiments of the present invention have a minimum distance d (as shown in FIGS. 2, 6 and 16) from the pair of electrical connections of the power supply and the housing that is less than 10 millimeters in one embodiment, less than 15 millimeters in another embodiment, or less than 25 millimeters in another embodiment. This minimum distance d, combined with large voltage differential between cathode 9 and anode 11, can indicate that the various embodiments described herein can effectively provide a removable connection between power supply 3 and x-ray tubes 8, even for small x-ray sources with very high voltage differentials.

What is claimed is:

1. An x-ray source device, comprising:

a. a power supply and an x-ray tube electrically, physically and releasably coupled together at a coupling formed therebetween;

b. the coupling comprising:

i. a plug extending from one of the power supply or the x-ray tube and a socket extending in towards the other of the power supply or the x-ray tube;

ii. a plug annular surface surrounding the plug at a base thereof and a socket annular surface surrounding the socket at a leading edge thereof;

iii. the plug having a tapered surface and a continuously reduced diameter from the base towards an end of the plug;

iv. the socket having a tapered surface and a continuously reduced diameter from the leading edge towards a bottom of the socket;

v. mating electrical connectors associated with the plug and the socket defining plug connectors and socket connectors, respectively, connecting when the plug is disposed in the socket, the electrical connectors configured to allow electrical current to flow from the power supply to the tube when connected;

vi. the tapered surfaces, the annular surfaces, or both, having a non-linear cross-sectional profile;

vii. the tapered surfaces and the annular surfaces of the plug and the socket substantially mating, with the plug insertable and receivable in the socket; and viii. the plug, and material forming the socket, comprising elastic, electrically insulative material; and c. the tapered surfaces abutting one another when coupled.

2. The device of claim 1, wherein:

a. the plug comprises a core region immediately surrounding the plug connectors and an outer region surrounding the core region;

b. a Durometer Shore A hardness of the core region divided by a Durometer Shore A hardness of the outer region is between 1.5 and 2.4.

3. The device of claim 2, wherein a Durometer Shore A hardness of the material forming the socket divided by the Durometer Shore A hardness of the outer region is between 0.95 and 1.05.

4. The device of claim 2, wherein the Durometer Shore A hardness of the outer region is between 40 and 60.

5. The device of claim 1, wherein:

a. the plug connectors are disposed at the end of the plug and the socket connectors are disposed at the bottom of the socket;

b. the plug connectors or the socket connectors including a central spring loaded pin connector and a first ring connector surrounding the pin connector and electrically insulated from the pin connector;

c. electrical connectors associated with the other of the plug or the socket including a plate connector and a second ring connector, the plate connector electrically insulated from the second ring connector; and d. the pin connector electrically contacting the plate connector and the first ring connector electrically contacting the second ring connector when the plug and the socket are coupled together.

6. The device of claim 1, wherein:

a. the non-linear cross-sectional profile includes a stepped profile on the tapered surface of the plug, comprising at least two steps, each step including an abrupt reduction in plug diameter;

b. the steps of the plug include longitudinal segments and radial segments;

c. the longitudinal segments having a smaller angle than the radial segments with respect to a centerline of the plug;

d. the non-linear cross-sectional profile includes a stepped profile on the tapered surface of the socket, comprising at least two steps, each including an abrupt reduction in socket diameter; and e. the stepped profiles of the plug and the socket mating with one another.

7. The device of claim 6, wherein the at least two steps comprises at least three steps.

8. The device of claim 6, wherein the angle between the radial segments and the centerline of the plug minus the angle between the longitudinal segments and the centerline of the plug is between 55 degrees and 75 degrees.

9. The device of claim 6, wherein the diameter of the plug is oversized to allow contact between longitudinal segments of the plug and the socket before contact between radial segments of the plug and socket, when coupling the power supply and the x-ray tube together.

10. The device of claim 6, wherein the longitudinal segments are at least three times longer than the radial segments.

11. A device in accordance with claim 1, wherein the socket is press fit with the plug having a lateral width greater than a corresponding lateral width of the socket at corresponding locations along a longitudinal length thereof.

12. The device of claim 1, wherein:

a. a plane of the plug annular surface is substantially perpendicular to a centerline of the plug;

b. a plane of the socket annular surface is substantially perpendicular to a centerline of the socket.

13. The device of claim 1, wherein:

a. the power supply is configured to provide, and the tube is configured to be operated at, a voltage of at least 39 kilovolts between a cathode and an anode of the x-ray tube;

b. an electron flight distance, from an electron emitter to a target of the x-ray tube, is less than 1 inch; and c. a distance from a plane of the plug annular surface along a centerline of the plug to the end of the plug is less than 30 millimeters.

14. The device of claim 1, wherein:

a. the annular surfaces comprise elastic, electrically insulative material;

b. the non-linear cross-sectional profile includes annular grooves on one of the plug annular surface or the socket annular surface and mating annular ridges on the other of the plug annular surface or the socket annular surface;

c. the annular surfaces abutting one another when coupled.

15. The device of claim 1, wherein:

a. the annular surfaces comprise elastic, electrically insulative material;

b. the non-linear cross-sectional profile includes annular grooves on the plug annular surface and mating annular ridges on the socket annular surface;

c. the non-linear cross-sectional profile includes annular grooves on the socket annular surface and mating annular ridges on the plug annular surface;

d. the annular surfaces abutting one another when coupled.

16. The device of claim 1, wherein:

a. the power supply includes a housing and the x-ray tube includes a shield, with both the housing and the shield being solid, non-flexible structures that are capable of being fastened together to form a single solid, non-flexible structure, and that are configured to be separated and rejoined without damage to the housing, the shield, or internal components in the housing or the shield;

b. the housing and the shield are maintained at ground voltage; and c. the power supply is configured to provide a voltage differential of at least 9 kilovolts between a cathode in the x-ray tube and the housing and shield.

17. The device of claim 1, wherein the plug connectors are disposed at the end of the plug and the socket connectors are disposed at the bottom of the socket.

18. A coupling device on a power supply or an x-ray tube, the device comprising:

a. a plug extending from, or a socket extending in towards, the power supply or the x-ray tube;

b. the plug or the socket having a tapered surface and a continuously reduced diameter;

c. the tapered surface having a non-linear profile and configured to mate with a non-linear profile of a tapered surface of a socket or plug;

d. the plug, or material forming the socket, comprising elastic, electrically insulative material;

e. electrical connectors associated with the plug or the socket; and f. the electrical connectors configured to allow electrical current to flow from the power supply to the tube when connected.

19. The device of claim 18, wherein:

a. the tapered surface has a stepped profile, comprising at least two steps, each step including an abrupt reduction in diameter;

b. the steps include longitudinal segments and radial segments;

c. the longitudinal segments having a smaller angle than the radial segments with respect to a centerline of the plug or socket; and d. an angle between the radial segments and the centerline of the plug or socket minus an angle between the longitudinal segments and the centerline of the plug or socket is greater than 30 degrees.

20. A coupling device on a power supply or an x-ray tube, the device comprising:

a. a plug extending from, or a socket extending in towards, the power supply or the x-ray tube;

b. the plug or the socket having a tapered surface and a continuously reduced diameter;

c. an annular surface surrounding the plug at a base or the socket at a leading edge thereof;

d. the tapered surface, the annular surface, or both, having a non-linear cross-sectional profile and configured to mate with a non-linear cross-sectional profile of a socket or plug;

e. the plug, or material forming the socket, comprising elastic, electrically insulative material; and f. electrical connectors associated with the plug or the socket, the electrical connectors configured to allow electrical current to flow from the power supply to the tube when connected.

* * * * *